United States Patent [19]

Sahai et al.

[11] Patent Number: 4,591,338

[45] Date of Patent: May 27, 1986

[54] PUSHER FURNACE

[75] Inventors: Yogeshwar Sahai, Worthington, Ohio; Joseph A. Clumpner, Towne & Country, Mo.

[73] Assignee: Swiss Aluminium Ltd., Chippis, Switzerland

[21] Appl. No.: 736,127

[22] Filed: May 20, 1985

[51] Int. Cl.[4] ..... F27B 3/22

[52] U.S. Cl. ..... 432/148; 432/152; 432/176

[58] Field of Search ..... 432/144, 152, 130, 148, 432/176

[56] References Cited

U.S. PATENT DOCUMENTS

| | | | |
|---|---|---|---|
| 1,891,981 | 12/1932 | Herbst | 432/152 |
| 2,039,429 | 5/1936 | Lydon | 432/176 |
| 3,537,405 | 11/1970 | Verhoeven | 432/152 |
| 3,905,760 | 9/1975 | Johansson et al. | 432/176 |
| 4,162,141 | 7/1979 | West | 432/144 |
| 4,395,233 | 7/1983 | Smith et al. | 432/176 |
| 4,493,641 | 1/1985 | Hubbert | 432/148 |
| 4,514,167 | 4/1985 | Roger | 432/152 |

*Primary Examiner*—Henry C. Yuen

*Attorney, Agent, or Firm*—Bachman & LaPointe

[57] ABSTRACT

A furnace for preheating and homogenizing aluminum ingots prior to hot rolling same wherein the heating efficiency is improved thus reducing the time required to heat the ingots to the homogenizing temperature. The furnace comprises an elongated housing having a ceiling, a floor and a pair of side walls extending from the floor to the ceiling for defining a chamber which is divided into an upper fan section and a lower ingot heating section. A plurality of fans are disposed in the upper fan section for circulating hot gases to the ingot heating section of the chamber. Baffles are associated with the side walls of the furnace for directing the hot gases toward the lower portion of the ingot heating section so as to cause the hot gases to flow between the ingots to be heated so as to contact the entire side wall surfaces thereof improving heating efficiency.

1 Claim, 2 Drawing Figures

PUSHER FURNACE

BACKGROUND OF THE INVENTION

The present invention relates to a metallurgical furnace and, more particularly, a metallurgical furnace for preheating and homogenizing aluminum ingots prior to hot rolling same.

Furnaces for heating aluminum ingots, commonly known as pusher furnaces, tend to be extremely inefficient when the furnace is designed to handle ingots of various sizes. The hot gases used to heat the ingots in the furnace tend to bounce off the floor of the furnace and flow predominantly over the top of the ingots from one end to the other thereby resulting in uneven heating of the ingots. By periodically reversing the flow of the hot gases during the heating of the ingots both ends of the ingot can be exposed to the maximum heat of the hot gases; however, the lower portion in the middle of the ingots away from the ends thereof is not exposed directly to the hot gases and therefore is heated only as a result of heat transferred from the top and ends of the ingot. As a result, excessive heat up times are required to bring the entire ingot to the homogenizing temperature thus decreasing the throughput of the furnaces.

Naturally, it would be highly desirable to provide a furnace for preheating and homogenizing aluminum ingots wherein the entire surface of the ingot including the side walls thereof are contacted with the furnace hot gases.

Accordingly, it is the principal object of the present invention to provide a metallurgfical furnace for effectively heating aluminum ingots.

It is a particular object of the present invention to provide a metallurgical furnace with baffles for directing the flow of hot gases to all sidewall surfaces of the ingots being heated.

Further objects and advantages will appear hereinbelow.

SUMMARY OF THE INVENTION

In accordance with the present invention the foregoing objects and advantages are readily obtained.

The present invention relates to a furnace for heating and homogenizing aluminum ingots prior to hot rolling. The furnace comprises an elongated housing having a ceiling, a floor and a pair of side walls extending from the floor to the ceiling for defining a chamber. The chamber is divided by a plate, which is substantially parallel to the floor and extends from side wall to side wall, into an upper fan section and a lower ingot heating section. A plurality of fans are disposed in the fan section for circulating hot gases to the lower ingot heating section. In accordance with the present invention, baffles are provided in association with the side walls for directing the hot gases toward the lower portion of the lower ingot heating section so as to cause the hot gases to flow between the ingots so as to contact the entire side wall surface thereof thereby improving the heating efficiency of the ingots. In accordance with a particular feature of the present invention, the baffles comprise a first elongated portion spaced from the side walls and extending from the divider plate towards the floor of the ingot heating section so as to define a flow passage between the first elongated portion and the side walls of the furnace. The baffle further includes a second elongated portion located beneath the first portion and extending from the side walls towards the interior of the lower ingot heating section so as to direct the hot gases from the flow passage toward the ingots to be heated.

The furnace of the present invention offers significant advantages over pusher furnaces heretofore known. Because of the improved heating efficiency, the time required to heat the ingots to the homogenizing temperature is reduced. By reducing the heating time, an increase in ingot throughput results thereby having a beneficial effect on the overall production capacity of an aluminum rolling plant.

Further advantages of the present invention will appear hereinafter.

DETAILED DESCRIPTION

Figure 1:
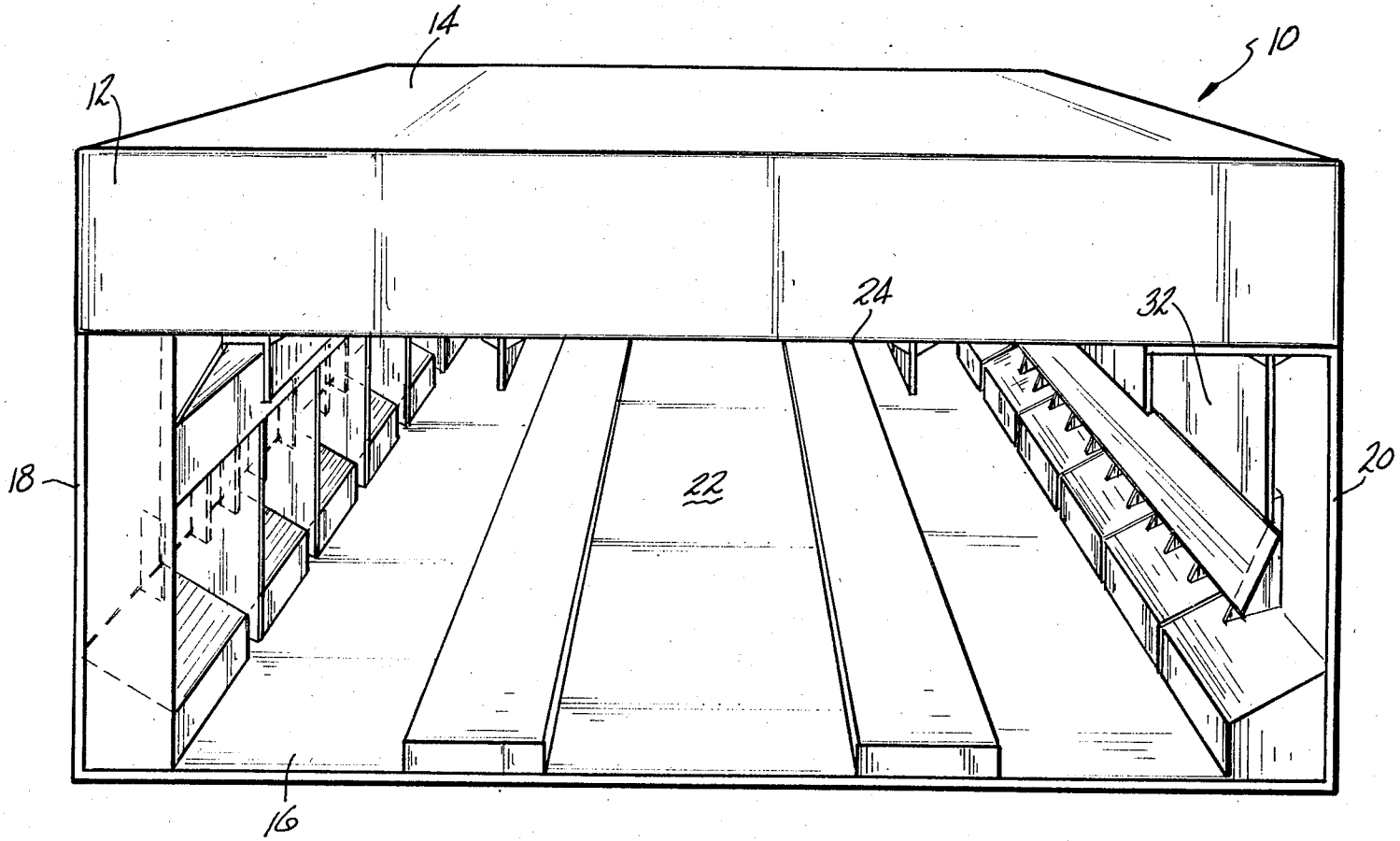
FIG. 1 is a schematic illustration of the furnace of the present invention.
Figure 2:
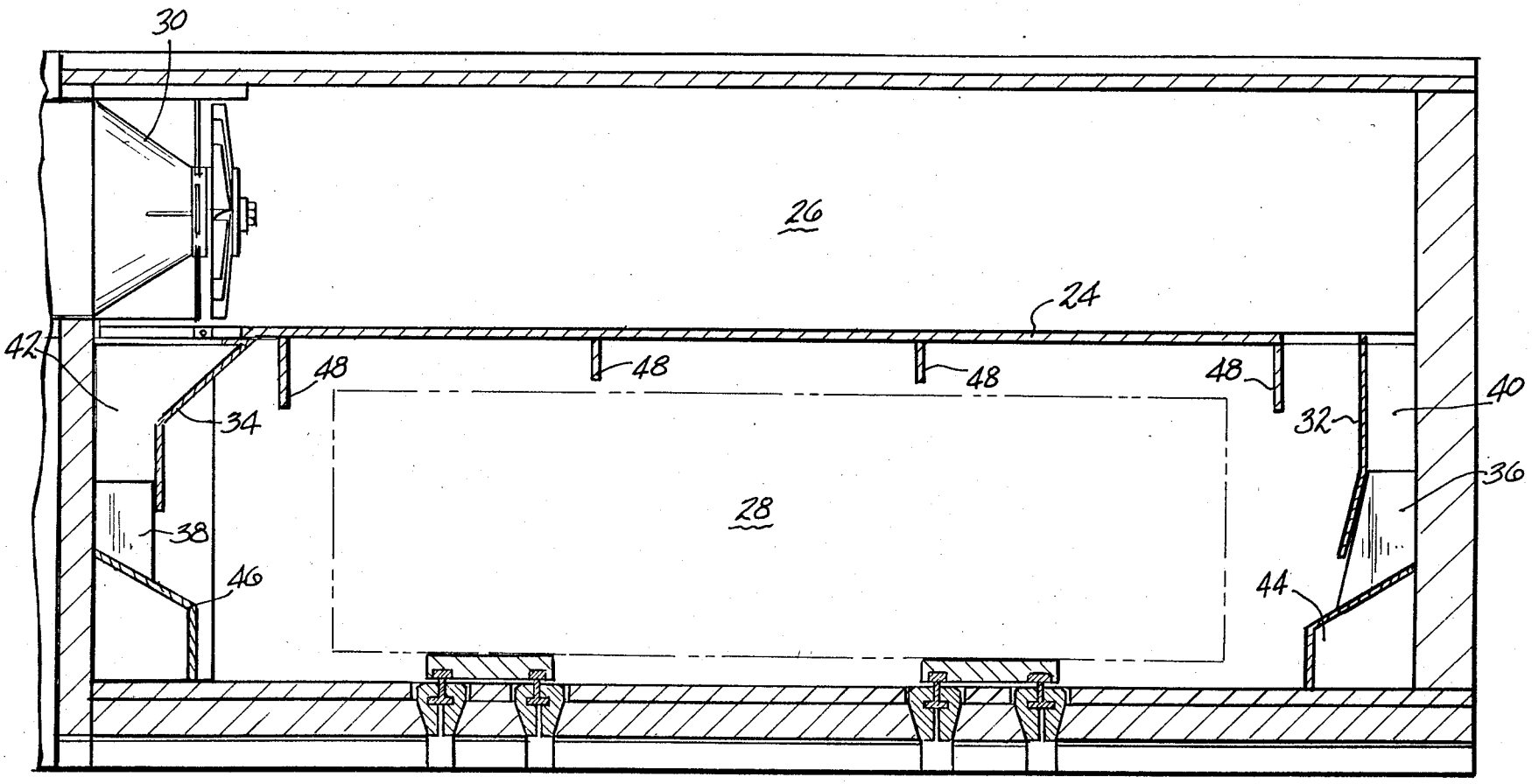
FIG. 2 is a sectional view of the furnace of the present invention illustrating the baffle arrangement in accordance with the present invention.

Referring in detail to the drawings, the furnace 10 of the present invention comprises an elongated housing 12 having a ceiling 14, a floor 16 and a pair of side walls 18 and 20, respectively, extending from the floor 16 to the ceiling 14 for defining a chamber 22. A divider plate 24 which runs substantially parallel to the floor 16 of the furnace 10 from side wall 18 to side wall 20 and the entire length of the furnace divides the chamber 22 into an upper fan section 26 and a lower ingot heating section 28. A plurality of fans 30 are provided in the fan section 26 for circulating hot gases to the lower ingot heating section.

In accordance with the present invention, in order to distribute the hot gases over the entire surface of the ingots being heated, baffles are associated with the side walls 18 and 20 for directing the hot gases under the bottom of and between the ingots to be heated. The baffles include first elongated portions 32, 34 which extend the entire length of the furnace 20. The elongated portions 32, 34 are suspended from divider plate 24 and are spaced from respective side walls 20 and 18 by means of flanges 36 and 38. The first elongated portions 32, 34 define with the side walls 20, 18 flow passages 40 and 42 for directing the hot gases from the upper fan section 26 to the lower portion of the lower ingot heating section 28. Second baffle portions 44 and 46 which also extend the length of the furnace are located beneath the first portions 32 and 34, respectively and project from the side walls 20 and 18, respectively towards the lower portion of the lower ingot heating section 28 so as to direct the hot gases from the flow passages 40 and 42 toward the ingots to be heated. The second portions 44 and 46 form an acute angle with the side walls 20 and 18. In accordance with a further feature of the present invention, a plurality of baffles 48 extend from the undersurface of divider plate 48 over the entire length of the furnace for directing the hot gases down from the undersurface of the divider plate.

As can be seen from the foregoing, the baffle arrangement of the present invention directs the hot gases towards the lower portion of the ingot heating section thereby allowing the hot gases to flow between the ingots thereby contacting the entire side wall surfaces of the ingots with the hot gases which results in improved heating efficiency. By improving the heating efficienty, the time required to heat the ingots to the homogenizing temperature is reduced.

The improved heating efficiency of the furnace of the present invention is illustrated by the following example. A pusher furnace, modified with the baffles in accordance with the present invention, was loaded with thirty-two aluminum alloy ingots having the following dimensions: 21"×54"×154". Thermocouples were mounted in various locations in selected ingots which were distributed at various locations in the furnace. The furnace was then operated in the conventional manner. The time to bring all the ingots to the homogenizing temperature throughtout the entire furnace was 13 hours. Prior to the furnace modifications in accordance with the present invention over 20 hours were required to heat the same sized ingots under the same furnace operating conditions to the homogenizing temperature.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A furnace for preheating and homogenizing aluminum ingots prior to hot rolling comprising an elongated housing having a ceiling, a floor and a pair of side walls extending from said floor to said ceiling for defining a chamber; divider means substantially parallel with said floor and extending from side wall to side wall for dividing said chamber into an upper fan section and a lower ingot heating section; circulating means disposed in said fan section for feeding hot gases to said ingot heating section; and baffle means associated with said side walls for directing said hot gases toward the lower portion of said lower ingot heating section so as to cause said hot gases to flow between the ingots to be heated so as to contact the entire side wall surfaces thereof thereby improving heating efficiency thus reducing the time required to heat the ingots to the homogenizing temperature, said baffle means comprises a first elongated portion spaced from at least one of said side walls and extending from said divider means toward said floor so as to define a flow passage between said first portion and said side walls, a second elongated portion located beneath said first portion and extending from said at least one side wall toward said floor so as to form an acute angle with said at least one side wall so as to direct hot gases from said flow passage toward the ingots to be heated and a plurality of elongated flanges substantially parallel to said side walls and extending from the underside of said divider means toward said floor.

* * * * *